US011608253B2

(12) United States Patent
Matsumoto

(10) Patent No.: US 11,608,253 B2
(45) Date of Patent: Mar. 21, 2023

(54) VERTICAL MOVING METHOD, VERTICAL MOVING APPARATUS, AND VERTICAL MOVING SYSTEM

(71) Applicant: HIRATA CORPORATION, Kumamoto (JP)

(72) Inventor: Bungo Matsumoto, Kumamoto (JP)

(73) Assignee: HIRATA CORPORATION, Kumamoto (JP)

( * ) Notice: Subject to any disclaimer, the term of this patent is extended or adjusted under 35 U.S.C. 154(b) by 217 days.

(21) Appl. No.: 17/071,402

(22) Filed: Oct. 15, 2020

(65) Prior Publication Data

US 2021/0024337 A1 Jan. 28, 2021

Related U.S. Application Data

(60) Division of application No. 16/026,182, filed on Jul. 3, 2018, now Pat. No. 10,858,227, which is a (Continued)

(30) Foreign Application Priority Data

Mar. 29, 2016 (JP) ..... JP2016-066270

(51) Int. Cl.
*B66F 7/00* (2006.01)
*B66F 7/02* (2006.01)
(Continued)

(52) U.S. Cl.
CPC ..... *B66F 7/02* (2013.01); *B66F 17/00* (2013.01); *B66F 19/00* (2013.01)

(58) Field of Classification Search
CPC .. B66F 7/00; B66F 7/02; B66F 7/0616; B66F 7/10; B66F 2700/00; B66F 2700/12
See application file for complete search history.

(56) References Cited

U.S. PATENT DOCUMENTS 8,905,223 B2 12/2014 Ichihara et al.
9,150,395 B2 10/2015 Kritzer
(Continued)

FOREIGN PATENT DOCUMENTS

CN 101571637 A 11/2009
CN 201627584 U 11/2010
(Continued)

OTHER PUBLICATIONS

Extended European Search Report dated Nov. 21, 2019, issued by the European Patent Office in corresponding European Application No. 19188267.9. (8 pages).
(Continued)

*Primary Examiner* — Lee D Wilson
(74) *Attorney, Agent, or Firm* — Buchanan Ingersoll & Rooney PC

(57) ABSTRACT

A vertical moving method of a vertical moving unit on which a conveyance target object is mounted includes steps of causing a non-electric biasing unit to generate a biasing force to raise the vertical moving unit, causing an electric motor unit to generate a thrust in a direction to raise the vertical moving unit or a thrust in a direction to lower the vertical moving unit, and causing an electromagnetic brake unit to generate a braking force to resist a movement of the vertical moving unit. Independently of presence/absence of the object and a weight of the object, the thrust and/or the braking force is controlled such that the vertical moving unit stops when an external force of overload more than a predetermined value acts on the vertical moving unit during a vertical movement.

8 Claims, 14 Drawing Sheets

Related U.S. Application Data continuation of application No. PCT/JP2017/011372, filed on Mar. 22, 2017.

(51) Int. Cl.
*B66F 17/00* (2006.01)
*B66F 19/00* (2006.01)

(56) References Cited

U.S. PATENT DOCUMENTS

| | | | | |
|---|---|---|---|---|
| 2004/0112682 | A1* | 6/2004 | Rauch | B66F 7/02 187/277 |
| 2010/0108445 | A1* | 5/2010 | Kritzer | B66F 3/46 187/218 |
| 2011/0084245 | A1* | 4/2011 | Penenburgh | B66F 17/00 254/2 R |
| 2013/0037385 | A1 | 2/2013 | Ichihara et al. | |
| 2016/0135587 | A1 | 5/2016 | Satou | |
| 2016/0185580 | A1* | 6/2016 | Luinge | G06F 3/0482 414/800 |
| 2018/0312379 | A1* | 11/2018 | Matsumoto | B66F 17/00 |

FOREIGN PATENT DOCUMENTS

| | | | |
|---|---|---|---|
| CN | 101982395 | A | 3/2011 |
| CN | 203649422 | U | 6/2014 |
| CN | 104210985 | A | 12/2014 |
| CN | 104828500 | A | 8/2015 |
| EP | 0608487 | A1 | 8/1994 |
| EP | 2740708 | A1 | 6/2014 |
| JP | H01303211 | A | 12/1989 |
| JP | H02255500 | A | 10/1990 |
| JP | H02263452 | A | 10/1990 |
| JP | H109303 | A | 1/1998 |
| JP | H11322284 | A | 11/1999 |
| JP | 2002096905 | A | 4/2002 |
| JP | 2004051300 | A | 2/2004 |
| JP | 2006327733 | A | 12/2006 |
| JP | 2010024014 | A | 2/2010 |
| JP | 2010269870 | A | 12/2010 |
| JP | 2013001557 | A | 1/2013 |
| JP | 2015067405 | A | 4/2015 |
| WO | 2012156583 | A1 | 11/2012 |
| WO | 2015089392 | A2 | 6/2015 |

OTHER PUBLICATIONS

Extended European Search Report dated Nov. 27, 2018, issued by the European Patent Office in corresponding European Application No. 17774561.9. (7 pages).

Office Action dated May 13, 2019, by the Chinese Patent Office in corresponding Chinese Patent Application No. 201780008951.5. (11 pages).

International Search Report (PCT/ISA/210) dated Jun. 27, 2017, by the Japan Patent Office as the International Searching Authority for International Application No. PCT/JP2017/011372.

Written Opinion (PCT/ISA/237) dated Jun. 27, 2017, by the Japan Patent Office as the International Searching Authority for International Application No. PCT/JP2017/011372.

* cited by examiner

VERTICAL MOVING METHOD, VERTICAL MOVING APPARATUS, AND VERTICAL MOVING SYSTEM

This application is a Divisional of U.S. patent application Ser. No. 16/026,182, filed Jul. 3, 2018, which is a Continuation of International Patent Application No. PCT/JP2017/011372, filed Mar. 22, 2017, which claims the benefit of Japanese Patent Application No. 2016-066270, filed Mar. 29, 2016, all of which are hereby incorporated by reference herein in their entirety.

TECHNICAL FIELD

The present invention relates to a vertical moving method, a vertical moving apparatus, and a vertical moving system.

BACKGROUND ART

To vertically move a conveyance target object in a production facility, a vertical moving apparatus using a biasing force like the gravity of a weight that does not consume power has been proposed for the purpose of reducing power consumption of a driving source (for example, Japanese Patent Laid-Open No. 2006-327733 and Japanese Patent Laid-Open No. 2015-67405).

When vertically moving a conveyance target object with a relatively heavy weight, a high-output motor is used in general. For this reason, safety measures for an operator against the driving force of the motor are required in some cases. As the facilities of safety measures, it is known that a safety fence configured to restrict the entry of the operator is provided around the vertical moving apparatus, or a sensor (light curtain or the like) configured to automatically stop the motor upon detecting the invasion of the operator is provided. However, several hundred or more of vertical moving apparatuses are sometimes arranged in a production line. In this case, safety measure facilities need to be provided as many as the number of vertical moving apparatuses, resulting in an enormous facility cost. In addition, since automatic stop of the motor caused by sensor detection influences a wide range of the production line, the actuation of the safety facilities leads to a considerable decrease in the production efficiency.

Here, even in the vertical moving apparatus using a high-output motor, if the thrust is so low that the motor can automatically be stopped by light contact of the operator on a movable portion of the vertical moving apparatus, the facilities of safety measures themselves are unnecessary, and the facility cost can largely be reduced.

SUMMARY OF INVENTION

It is an object of the present invention to provide a vertical moving method and a vertical moving apparatus, which do not need facilities of safety measures.

According to an aspect of the present invention, there is provided a vertical moving method of a vertical moving unit on which a conveyance target object is mounted, comprising steps of: causing a non-electric biasing unit to generate a biasing force to raise the vertical moving unit; causing an electric motor unit to generate a thrust in a direction to raise the vertical moving unit or a thrust in a direction to lower the vertical moving unit; and causing an electromagnetic brake unit to generate a braking force to resist a movement of the vertical moving unit, wherein independently of presence/absence of the conveyance target object and a weight of the conveyance target object placed on the vertical moving unit, the thrust and/or the braking force is controlled such that the vertical moving unit stops when an external force of overload more than a predetermined value acts on the vertical moving unit during a vertical movement.

According to another aspect of the present invention, there is provided a vertical moving apparatus comprising: a vertical moving unit on which a conveyance target object is mounted; a support unit configured to vertically movably support the vertical moving unit; a non-electric biasing unit configured to generate a biasing force to raise the vertical moving unit; an electric motor unit configured to generate a thrust for a vertical movement of the support unit; an electromagnetic brake unit configured to apply a braking force to the vertical movement of the support unit; and a control unit configured to, independently of a weight of the conveyance target object placed on the vertical moving unit, control the braking force by the electromagnetic brake unit and/or the thrust by the electric motor unit such that the vertical moving unit stops when an external force of overload more than predetermined value acts on the vertical moving unit during a vertical movement.

According to still another aspect of the present invention, there is provided a vertical moving system comprising: a first vertical moving apparatus; and a second vertical moving apparatus, wherein each of the first vertical moving apparatus and the second vertical moving apparatus comprises: a vertical moving unit; a support unit configured to vertically movably support the vertical moving unit; a non-electric biasing unit configured to generate a biasing force to raise the vertical moving unit; an electric motor unit configured to generate a thrust for a vertical movement of the support unit; and an electromagnetic brake unit configured to apply a braking force to the vertical movement of the support unit, the vertical moving system further comprises a placement member laid in a horizontal orientation between the vertical moving unit of the first vertical moving apparatus and the vertical moving unit of the second vertical moving apparatus and configured to place a conveyance target object, and the vertical moving unit of the first vertical moving apparatus and/or the vertical moving unit of the second vertical moving apparatus includes a floating mechanism configured to permit relative horizontal movements of the vertical moving unit and the placement member.

Further features of the present invention will become apparent from the following description of exemplary embodiments (with reference to the attached drawings).

DESCRIPTION OF EMBODIMENTS

Figure 1A:
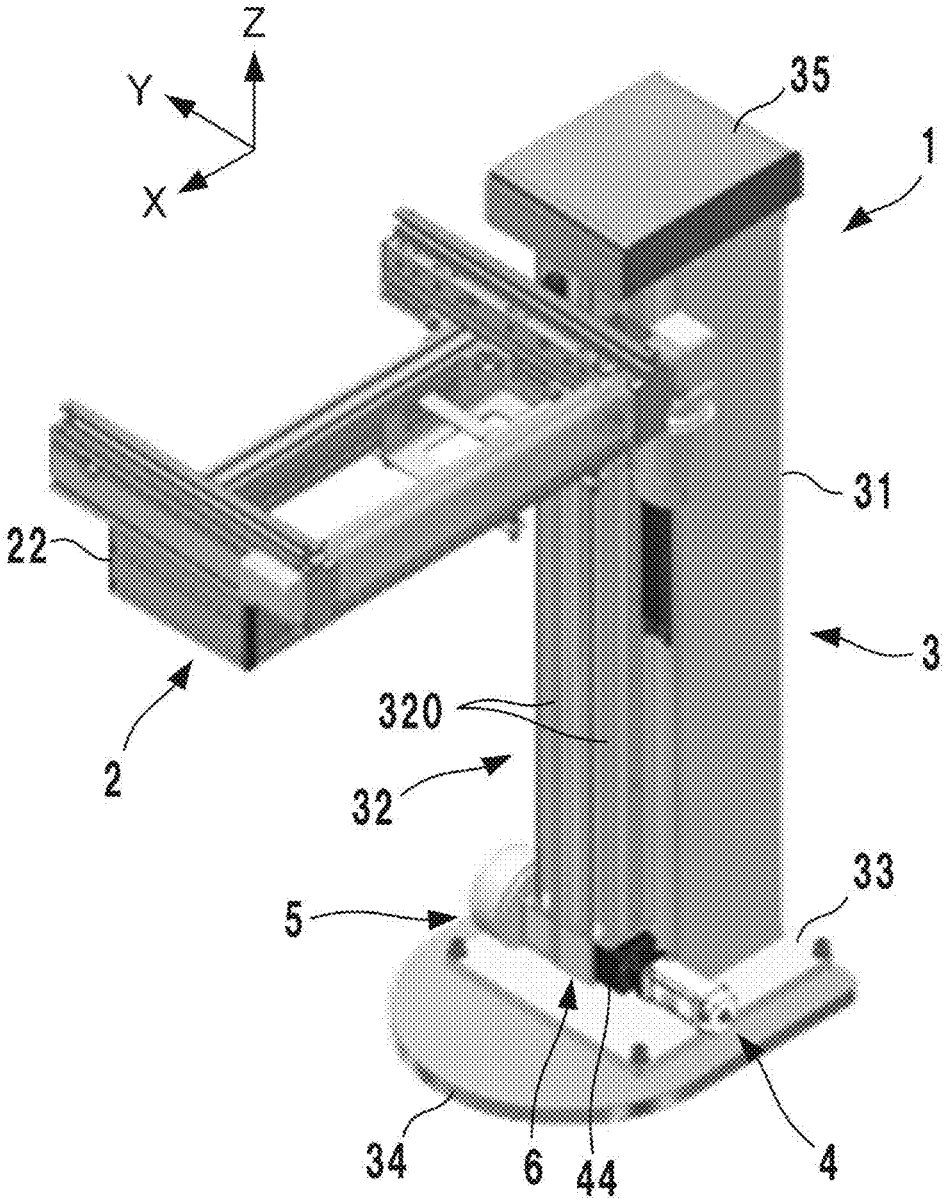
FIG. 1A is a perspective view of a vertical moving apparatus according to an embodiment of the present invention.

A vertical moving apparatus according to an embodiment of the present invention will be described with reference to the accompanying drawings. Note that in the drawings, arrows X and Y indicate horizontal directions orthogonal to each other, and an arrow Z indicates a vertical (plumb) direction.

<Arrangement of Vertical Moving Apparatus>

Figure 1B:
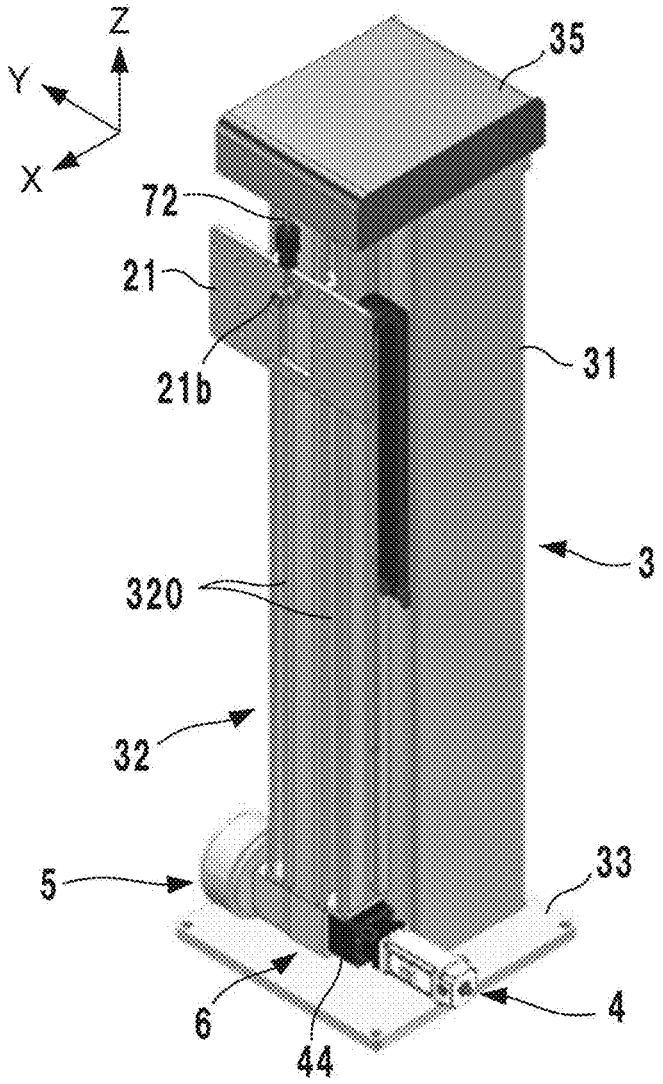
FIG. 1B is a perspective view showing a form in which some components of the vertical moving apparatus shown in FIG. 1A are removed.
Figure 2:
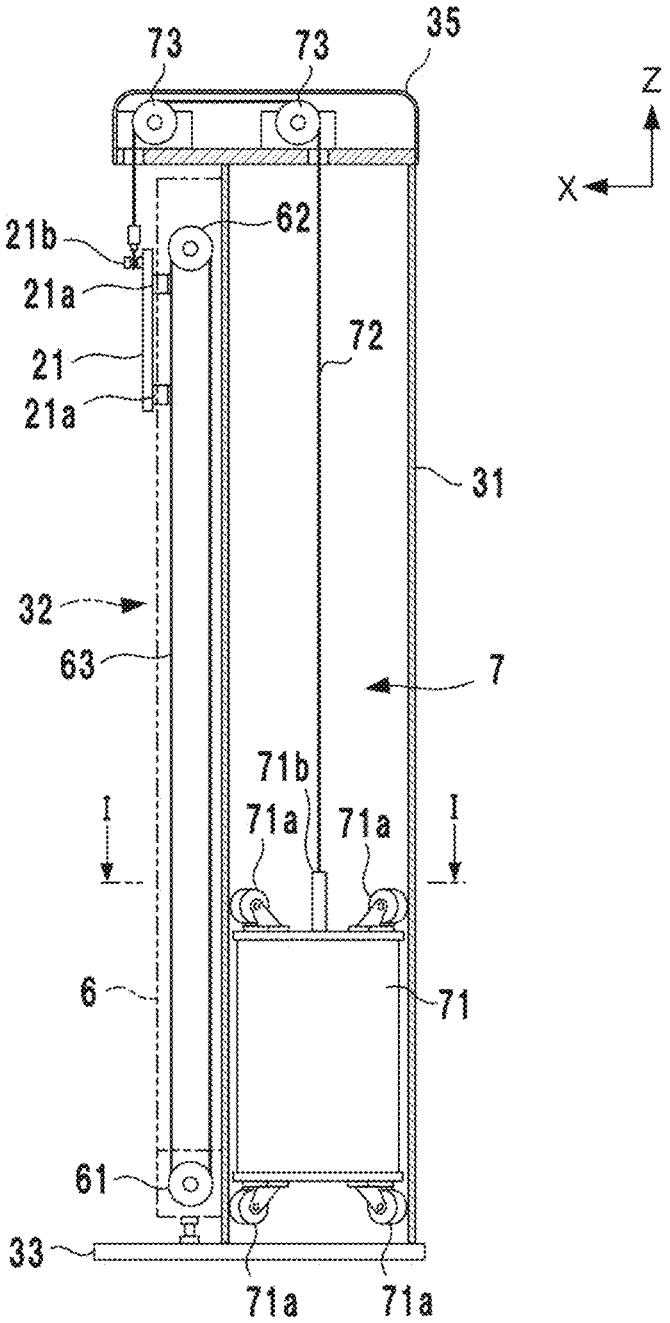
FIG. 2 is an explanatory view showing the internal structure of the vertical moving apparatus shown in FIG. 1A.

FIG. 1A is a perspective view of a vertical moving apparatus 1 according to an embodiment of the present invention, and FIG. 1B is a perspective view of the vertical moving apparatus 1 in which some components are removed. FIG. 2 is an explanatory view showing the internal structure of the vertical moving apparatus 1.

The vertical moving apparatus 1 includes a vertical moving unit 2, a support unit 3, a biasing unit 7, an electric motor unit 4, and an electromagnetic brake unit 5.

The vertical moving unit 2 is a unit on which a conveyance target object is placed. In this embodiment, the vertical moving unit 2 includes a slider 21 and a placement unit 22. The slider 21 is vertically movably supported by the support unit 3. In this embodiment, the slider 21 is a plate-shaped member. The placement unit 22 is detachably fixed to the slider 21. A plurality of placement units 22 of different sizes or functions can be prepared. The different function may be, for example, the presence/absence of a conveyor function. The placement unit 22 of an appropriate type (size and shape) is selected in accordance with the conveyance target object and attached to the slider 21. This allows the vertical moving apparatus 1 with a common basic arrangement to cope with a variety of conveyance target objects or conveying operations.

The support unit 3 includes a columnar main body 31. In this embodiment, the main body 31 is a hollow body having a square tubular shape and extends in the vertical direction. A guide (LM guide) 32 extending in the vertical direction is provided on the front portion of the main body 31. The guide 32 includes a driving mechanism 6 to be described later and guide units 320 provided on both sides of the driving mechanism 6. Each guide unit 320 includes, in its front surface, a pair of left and right grooves extending in the vertical direction. The slider 21 includes a pair of left and right engaging portions 21*a*. These engaging portions are inserted into the grooves of the guide unit 320 and fixed to a traveling member 63 to the described later. Along with traveling of the traveling member 63 in the vertical direction, the slider 21 vertically moves along the guide 32.

The top of the main body 31 is covered with a cover 35. A bottom plate 33 is fixed to the bottom of the main body 31. A base plate 34 fixed to a floor surface or the like by anchor bolts or the like is further detachably fixed to the bottom plate 33. A plurality of types of base plates 34 in different sizes can be prepared. The base plate 34 is selected in accordance with the conveyance target object or the placement unit 22 and attached to the bottom plate 33. This allows the vertical moving apparatus 1 with a common basic arrangement to cope with a variety of conveyance target objects or conveying operations.

The biasing unit 7 is arranged in the main body 31 and in the cover 35. The biasing unit 7 is a non-electric unit configured to generate a biasing force to raise the vertical moving unit 2 and the conveyance target object. In this embodiment, the biasing unit 7 is a unit that generates a biasing force using the gravity of a weight member 71. However, a biasing unit using a spring balancer or the like and configured to generate a biasing force using the elastic force of the spring can also be employed.

Figure 4A:
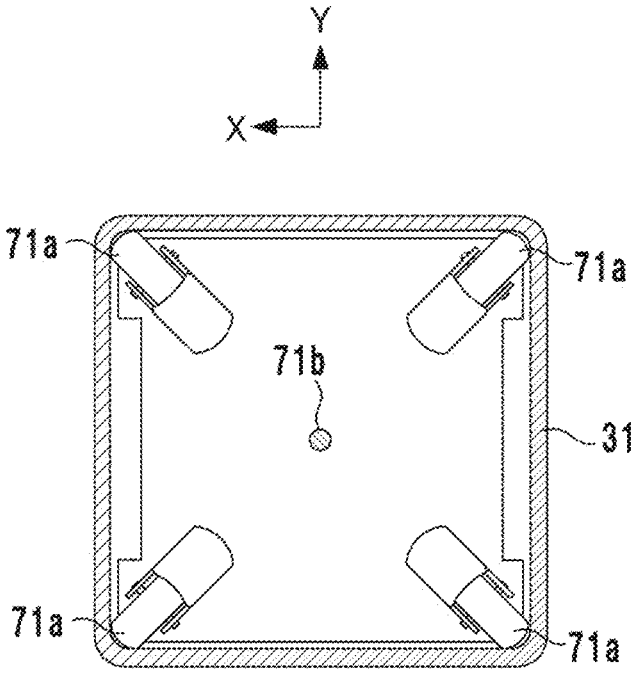
FIG. 4A is a sectional view taken along a line I-I in FIG. 2.

The weight member 71 is stored in the main body 31 so as to be movable in the vertical direction. FIG. 4A is a sectional view taken along a line I-I in FIG. 2 and shows the storage form of the weight member 71. The weight member 71 has a rectangular parallelepiped shape as a whole, and rollers 71*a* are provided at the corner portions of the top and the bottom. Since the rollers 71*a* are in slidable contact with the corner portions of the inner wall surface of the main body 31, the weight member 71 can smoothly be moved in the vertical direction.

One end of a wire 72 is connected to the top of the weight member 71 via a connector 71*b*. As shown in FIG. 2, the wire 72 is laid over a plurality of pulleys 73 arranged in the cover 35, and the other end of the wire 72 is connected to a connector 21*b* provided on the slider 21. Since the gravity of the weight member 71 acts on the vertical moving unit 2 via the wire 72, the vertical moving unit 2 always receives the biasing force that raises the vertical moving unit 2.

The guide 32 is provided on the front portion of the main body 31, and the pair of guide units 320 are arranged on both sides of the driving mechanism 6. The driving mechanism 6 is a driving transmission mechanism that transmits the driving force (thrust) of the electric motor unit 4 or the braking force of the electromagnetic brake unit 5 to the vertical moving unit 2. In this embodiment, a belt transmission mechanism is employed as the driving mechanism 6. However, a driving transmission mechanism of another type such as a chain transmission mechanism or a rack-and-pinion mechanism can also be employed.

The driving mechanism 6 includes rotation bodies 61 and 62 arranged while being spaced apart in the vertical direction, and the endless traveling member 63 wound around the rotation bodies 61 and 62. In this embodiment, the traveling member 63 is, for example, an annular timing belt, and the rotation bodies 61 and 62 are, for example, toothed pulleys. The engaging portions 21*a* of the slider 21 are fixed to the traveling member 63. Along with the travel of the traveling member 63, the slider 21 is moved in the vertical direction, and the vertical moving unit 2 is vertically moved.

Figure 3:
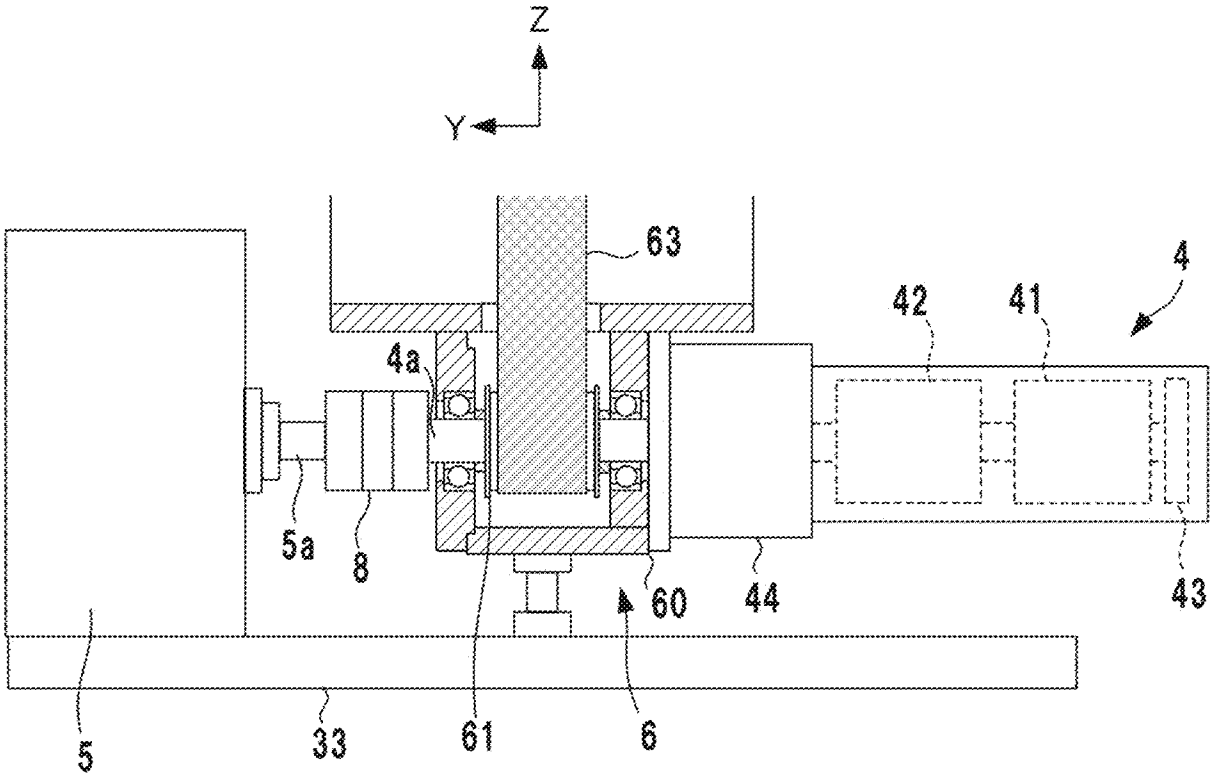
FIG. 3 is an explanatory view showing a structure on the periphery of the driving mechanism of the vertical moving apparatus shown in FIG. 1A.

The electric motor unit 4 and the electromagnetic brake unit 5 are arranged on the outer sides of the two guide units 320 in the lower portion of the support unit 3. Since the two units 4 and 5 are arranged at low positions, maintenance is easy. FIG. 3 is an explanatory view showing a structure on the periphery of the driving mechanism 6 of the vertical moving apparatus 1 and particularly shows the arrangements of the rotation body 61, the electric motor unit 4, and the electromagnetic brake unit 5.

The electric motor unit 4 is an actuator that generate a thrust for the vertical movement of the vertical moving unit 2. In this embodiment, the electric motor unit 4 includes an electric motor 41, an electromagnetic brake 42, a rotary encoder 43, and a decelerator 44. The electric motor 41 is, for example, a DC servo motor. The electric motor 41 is sometimes simply referred to as the motor 41. The rotary encoder 43 is a sensor that detects the rotation of the motor 41. The rotary encoder 43 is sometimes simply referred to as the encoder 43.

The electromagnetic brake 42 is a brake capable of braking the rotation of the output shaft of the motor 41. In this embodiment, the electromagnetic brake 42 is set in a non-braking state upon energization and in a braking state upon non-energization. Hence, power is supplied to the electromagnetic brake 42 basically during driving of the motor 41. The power supply to the electromagnetic brake 42 is cut when the motor 41 stops. As the electromagnetic brake 42, a known electromagnetic brake that generates a braking force using the biasing force of a spring or the like can be employed. Note that an arrangement in which the electromagnetic brake 42 is not provided can also be employed.

The output of the motor 41 is input to the decelerator 44 via the electromagnetic brake 42, decelerated by the decelerator 44, and output from an output shaft 4*a*. Note that an arrangement in which the decelerator 44 is not provided can also be employed. The output shaft 4*a* is fitted in the shaft of the rotation body 61, and the rotation body 61 is rotated by driving the electric motor unit 4. That is, a thrust for the vertical movement of the vertical moving unit 2 is applied by the electric motor unit 4.

An input shaft 5*a* of the electromagnetic brake unit 5 is connected to the output shaft 4*a* via a coupling 8. The electromagnetic brake unit 5 is a unit that applies a braking force against the vertical movement of the vertical moving unit 2. The electromagnetic brake unit 5 generates a braking force to resist the rotation of the output shaft 4*a*. Hence, the electromagnetic brake unit 5 applies the braking force to the rotation body 61, and the braking force against the vertical movement of the vertical moving unit 2 is thus applied. The electromagnetic brake unit 5 is, for example, a powder brake and is set in a braking state upon energization and in a non-braking state upon non-energization. The braking torque can be controlled by a current value upon energization. In addition, the electromagnetic brake unit 5 can store a plurality of current values, that is, braking torque values, and can store a plurality of patterns corresponding to cases in which parameters such as patterns in raising and in lowering and the type and weight of a work are different.

The electric motor unit 4 and the electromagnetic brake unit 5 can be arranged in different portions. For example, an arrangement in which the electric motor unit 4 is connected to the rotation body 61, and the electromagnetic brake unit 5 is connected to the rotation body 62 can also be employed. In addition, an arrangement in which the electric motor 4 or the electromagnetic brake unit 5 is mounted on the slider 21 can also be employed depending on the arrangement of the driving mechanism 6.

<Control Unit>

Figure 4B:
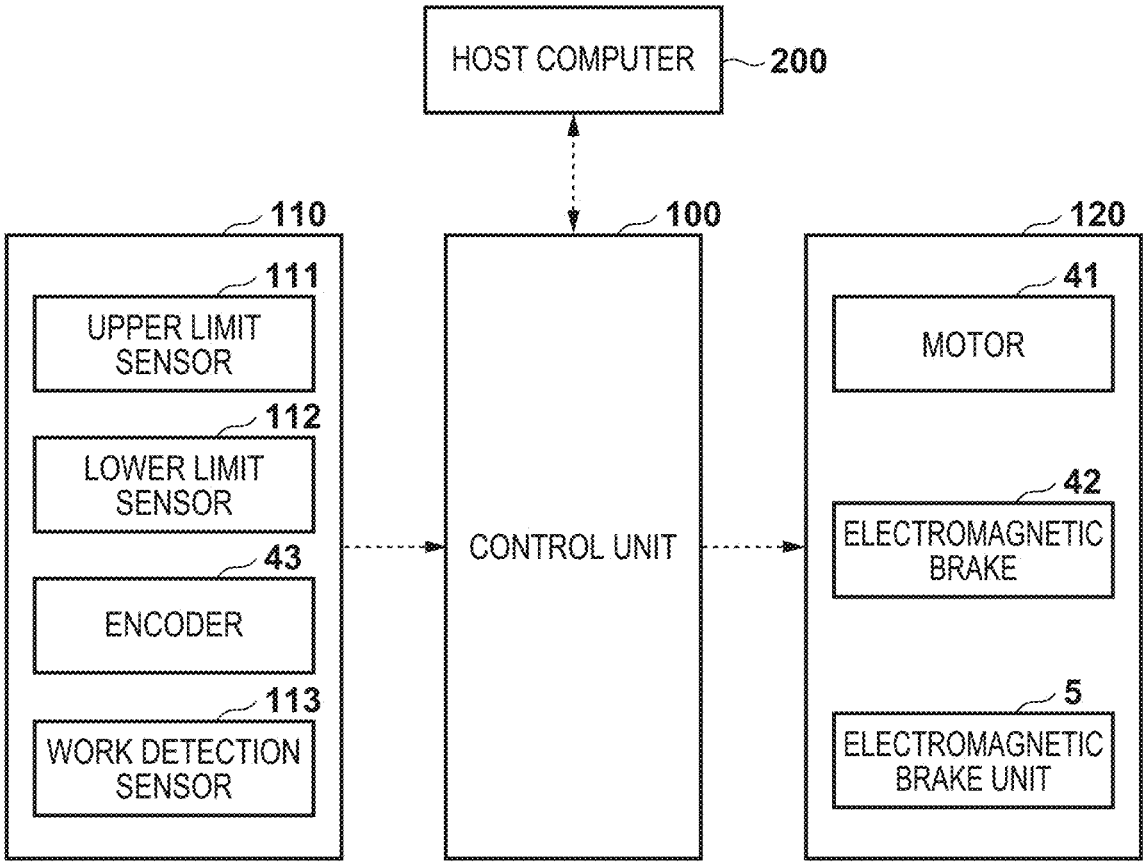
FIG. 4B is a block diagram of the control system of the vertical moving apparatus shown in FIG. 1A.

The arrangement of the control system of the vertical moving apparatus 1 will be described with reference to FIG. 4B. The vertical moving apparatus 1 is controlled by a control unit 100. The control unit 100 is, for example, a PLC (Programmable Logic Controller). The control unit 100 can communicate with a host computer 200 in a production facility in which the vertical moving apparatus 1 is installed and performs control in accordance with an instruction of the host computer 200.

The control unit 100 drives an actuator 120 based on the detection result of a sensor 110. The sensor 110 includes an upper limit sensor 111, a lower limit sensor 112, the encoder 43, and a work detection sensor 113. The upper limit sensor 111 is a sensor configured to detect that the vertical moving unit 2 arrives at an upper limit position, which is, for example, a photosensor arranged on the main body 31 to detect a detection piece provided on the vertical moving unit 2 at the upper limit position. The lower limit sensor 112 is a sensor configured to detect that the vertical moving unit 2 arrives at a lower limit position, which is, for example, a photosensor arranged on the main body 31 to detect the detection piece provided on the vertical moving unit 2 at the lower limit position. The work detection sensor 113 is a sensor configured to detect whether the conveyance target object is placed on the vertical moving unit 2, which is, for example, a photosensor arranged on the vertical moving unit 2. The actuator 120 includes the motor 41, the electromagnetic brake 42, and the electromagnetic brake unit 5.

<Load Balance>

In this embodiment, the non-electric biasing unit 7 is used aiming at allowing a motor of a lower output to be used as the motor 41 to take a safety measure for an operator rather than aiming at reducing power consumption. Since the biasing unit 7 generates a biasing force to raise the vertical moving unit 2, the driving force of the motor 41 used to raise the vertical moving unit 2 can be made smaller. In addition, when the braking force of the electromagnetic brake unit 5 is combined, various load balances can be generated for raising and lowering of the vertical moving unit 2, and this makes it possible to flexibly cope with conveyance target objects of different weights. Accordingly, the conveyance target object can be vertically moved using a motor of a lower output as the motor 41.

In the vertical moving apparatus 1 according to this embodiment, as a safety measure, independently of the weight of the conveyance target object, one of the braking force by the electromagnetic brake unit 5 and the thrust by the electric motor unit 4 is controlled to stop the vertical moving unit 2 when a predetermined external force F acts on the vertical moving unit 2 during a vertical movement so that an overload state is generated. The load balance is set such that the vertical moving unit 2 is stopped, in other words, the vertical moving unit 2 is vertically moved by a low thrust when a force within the range of, for example, 50 N to 150 N acts as the external force F. Accordingly, even if the operator unintentionally interferes with the vertical moving unit 2 during a vertical movement, the vertical movement of the vertical moving unit 2 is stopped by the action of the small external force F. Hence, the operator is never injured or caught in the facility. That is, the vertical moving apparatus 1 according to this embodiment can ensure the safety of the operator without specially providing a safety facility.

Figure 5:
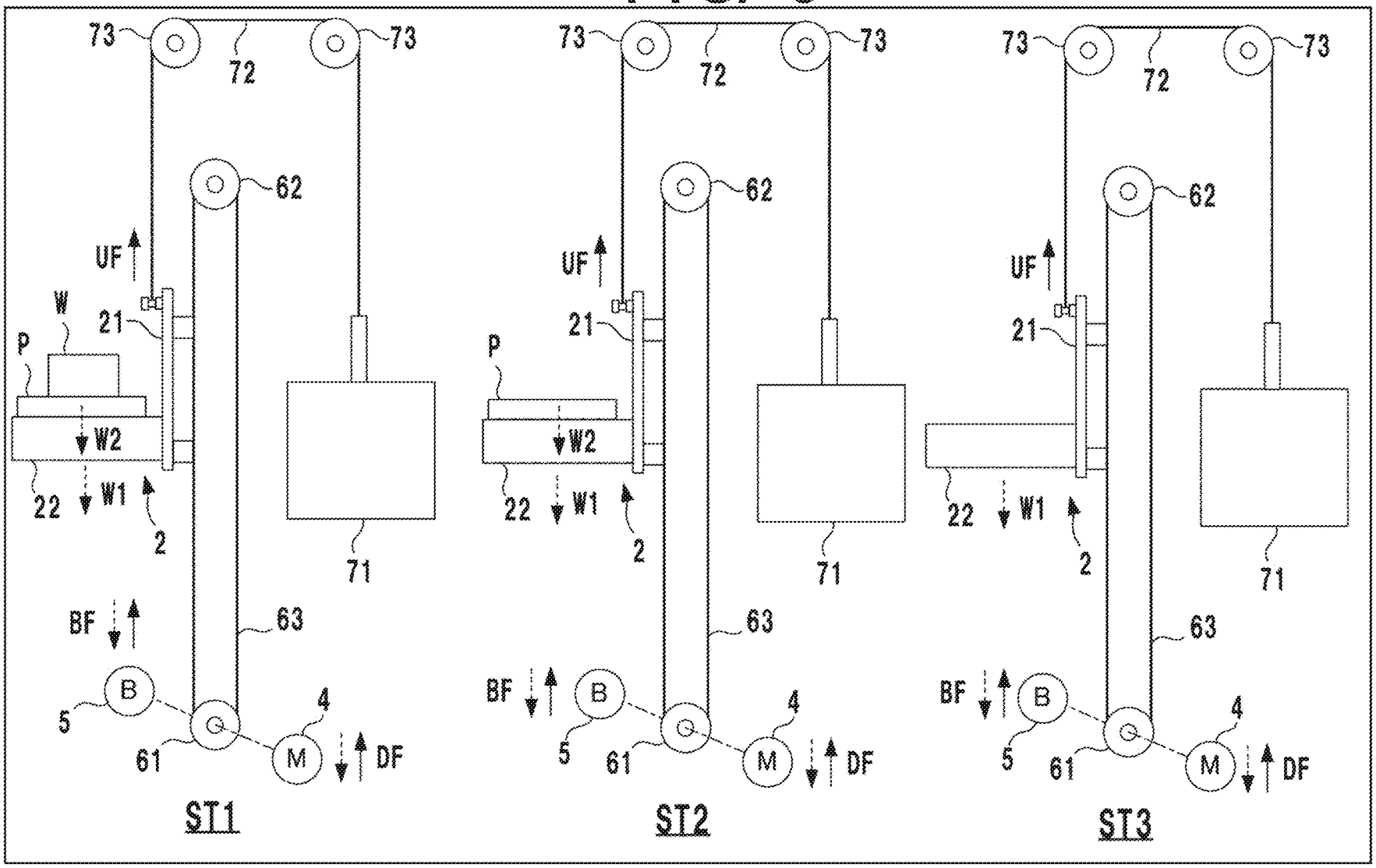
FIG. 5 is an explanatory view showing an example of control contents.

FIG. 5 shows an example of setting of the load balance. Referring to FIG. 5, UF represents a biasing force in a raising direction, which is made to act on the vertical moving unit 2 by the weight member 71. DF represents a driving force in the raising direction or lowering direction, which is made to act on the vertical moving unit 2 by the electric motor unit 4. BF represents a braking force in the raising direction or lowering direction, which is made to act on the vertical moving unit 2 by the electromagnetic brake unit 5. This force acts in a direction reverse to the moving direction of the vertical moving unit 2. W1 is a weight of the vertical moving unit 2. W2 is a weight of the conveyance target object. As for these values, the force in the direction to raise the vertical moving unit 2 is defined as a positive value, and the force in the direction to lower the vertical moving unit 2 is defined as a negative value. At this time, concerning the external force F, at least one of the electric motor unit 4 and the electromagnetic brake unit 5 is controlled to satisfy $$DF-BF-\{(W1+W2)-UF\}\leq F$$

A detailed example will be described. Here, the weight W1 is set to 300 N, the biasing force UF is set to 400 N, and the vertical moving unit 2 is vertically moved at a constant speed. ST1 in FIG. 5 shows an example in which as the conveyance target object, a pallet P and a work W on the pallet P are placed on the vertical moving unit 2. The weight W2 of the conveyance target object is the sum of the weights of the pallet P and the work W, which is 115 N+60 N=175 N.

The motor 41 is driven such that the driving force DF becomes constant at 155 N, and the rotation direction is switched such that the driving force acts in the raising direction at the time of raising and in the lowering direction at the time of lowering. When the electromagnetic brake unit 5 is turned off at the time of raising, $$F=(400\text{ N}+155\text{ N})-(300\text{ N}+175\text{ N})=80\text{ N}$$

holds. That is, in a case in which the pallet P and the work W are placed on the vertical moving unit 2, when the operator lightly abuts against the vertical moving unit 2, for example, the external force F of overload more than 80 N acts at the time of raising or lowering, the vertical movement of the vertical moving unit 2 is stopped.

When the electromagnetic brake unit 5 is turned on, and the braking force BF is set to 150 N at the time of lowering, $$F=(400\text{ N}+150\text{ N})-(300\text{ N}+175\text{ N}+155\text{ N})=-80\text{ N}$$

holds, like the time of raising.

ST2 in FIG. 5 shows an example in which as the conveyance target object, only the pallet P is placed on the vertical moving unit 2. In other words, this assumes a state after the work W is transferred in the state ST1 in FIG. 5.

The motor 41 is driven such that the driving force DF becomes constant at 155 N, and the rotation direction is switched such that the driving force acts in the raising direction at the time of raising and in the lowering direction at the time of lowering. When the electromagnetic brake unit 5 is turned on, and the braking force BF is set to 60 N at the time of raising, $$F=(400\text{ N}+155\text{ N})-(300\text{ N}+115\text{ N}+60\text{ N})=80\text{ N}$$

holds.

When the electromagnetic brake unit 5 is turned on, and the braking force BF is set to 90 N at the time of lowering, $$F=(400\text{ N}+90\text{ N})-(300\text{ N}+115\text{ N}+155\text{ N})=-80\text{ N}$$

holds. That is, even in a case in which only the pallet P is placed on the vertical moving unit 2, when the operator lightly abuts against the vertical moving unit 2, for example, the external force F of overload more than 80 N acts at the time of raising or lowering, the vertical movement of the vertical moving unit 2 is stopped.

When the state ST1 and the state ST2 in FIG. 5 are repeated, the driving force DF by the electric motor unit 4 can be controlled to a predetermined value, and the braking force BF by the electromagnetic brake unit 5 can be controlled in accordance with the presence/absence of the conveyance target object (here, the presence/absence of the work W) and the weight of the conveyance target object at the time of raising or lowering of the vertical moving unit 2. The control contents can be made relatively simple. In addition, the output of the electric motor unit 4 can be a relatively weak force and can always be constant, resulting in higher safety. Furthermore, the electromagnetic brake unit 5 that brakes the vertical moving unit 2 but does not move it is controlled. Even if the braking force is made large, the vertical moving unit 2 never vertically moves, resulting in higher safety.

ST3 in FIG. 5 shows an example in which the conveyance target object is not placed on the vertical moving unit 2. The motor 41 is driven such that the driving force DF becomes constant at 180 N, and the rotation direction is switched such that the driving force acts in the raising direction at the time of raising and in the lowering direction at the time of lowering. When the electromagnetic brake unit 5 is turned on, and the braking force BF is set to 200 N at the time of raising, $$F=(400\text{ N}+180\text{ N})-(300\text{ N}+200\text{ N})=80\text{ N}$$

holds.

When the electromagnetic brake unit 5 is turned off at the time of lowering, $$F=(400\text{ N})-(300\text{ N}+180\text{ N})=-80\text{ N}$$

holds. That is, even in a case in which the conveyance target object is not placed on the vertical moving unit 2, when the operator lightly abuts against the vertical moving unit 2, for example, the external force F of overload more than 80 N acts at the time of raising or lowering, the vertical movement of the vertical moving unit 2 is stopped.

Note that to make the vertical moving unit 2 stand still, the electromagnetic brake 42 is set in the braking state, and the rotation of the rotation body 61 is locked.

<Example of Control>

Figure 6A:
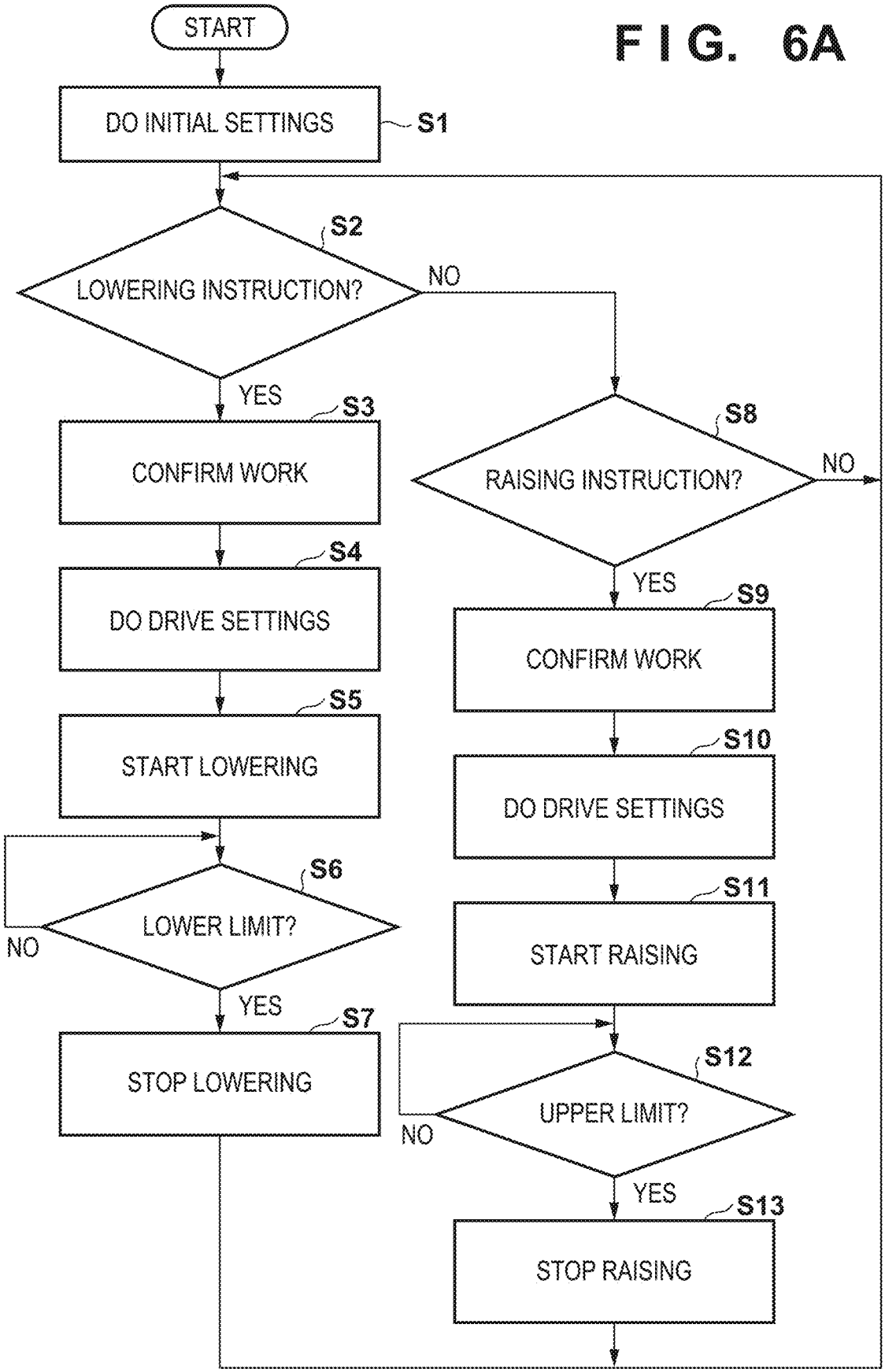
FIG. 6A is a flowchart showing an example of control of the vertical moving apparatus shown in FIG. 1A.

FIG. 6A is a flowchart showing an example of control executed by the control unit 100. Here, assume a case in which the work W is placed via the pallet P, as shown in ST1 or ST2 in FIG. 5, and assume a case in which the work detection sensor 113 detects the presence/absence of placement of the work W.

In step S1, initial settings are done. Here, operation settings of the motor 41 and the electromagnetic brake unit 5 and the like are performed for the time of raising and the time of lowering in accordance with the weight of the conveyance target object. The initial position of the vertical moving unit 2 can be either the upper limit position or the lower limit position.

In step S2, it is determined whether a lowering instruction is received from the host computer 200. If YES in step S2, the control procedure advances to step S3. If NO in step S2, the control procedure advances to step S8. In step S3, the detection result of the work detection sensor 113 is acquired, and it is confirmed whether the work W is placed. After that, the control procedure advances to step S4 to set the driving conditions of the motor 41 and the electromagnetic brake unit 5 based on the initial settings in step S1 and the confirmation result in step S3.

In step S5, the electromagnetic brake 42 is energized and set in the non-braking state. In addition, the motor 41 and the electromagnetic brake unit 5 are controlled in accordance with the settings in step S4, and lowering of the vertical moving unit 2 is started. In step S6, the detection result of the lower limit sensor 112 is acquired, and it is determined whether the vertical moving unit 2 has reached the lower limit position. If it is determined that the vertical moving unit 2 has reached the lower limit position, in step S7, the energization to the electromagnetic brake 42 is cut to set the electromagnetic brake 42 in the braking state, and the motor 41 and the electromagnetic brake unit 5 are stopped. In addition, the host computer 200 is notified that the vertical moving unit 2 has reached the lower limit position. After that, the control procedure returns to step S2.

In step S8, it is determined whether a raising instruction is received from the host computer 200. If a raising instruction is received, the control procedure advances to step S9. If a raising instruction is not received, the control procedure returns to step S2. In step S9, the detection result of the work detection sensor 113 is acquired, and it is confirmed whether the work W is placed. After that, the control procedure advances to step S10 to set the driving conditions of the motor 41 and the electromagnetic brake unit 5 based on the initial settings in step S1 and the confirmation result in step S9.

In step S11, the electromagnetic brake 42 is energized and set in the non-braking state. In addition, the motor 41 and the electromagnetic brake unit 5 are controlled in accordance with the settings in step S10, and raising of the vertical moving unit 2 is started. In step S12, the detection result of the upper limit sensor 111 is acquired, and it is determined whether the vertical moving unit 2 has reached the upper limit position. If it is determined that the vertical moving unit 2 has reached the upper limit position, in step S13, the energization to the electromagnetic brake 42 is cut to set the electromagnetic brake 42 in the braking state, and the motor 41 and the electromagnetic brake unit 5 are stopped. The host computer 200 is notified that the vertical moving unit 2 has reached the upper limit position. After that, the control procedure returns to step S2, and the same processing as described above is repeated.

Figure 6B:
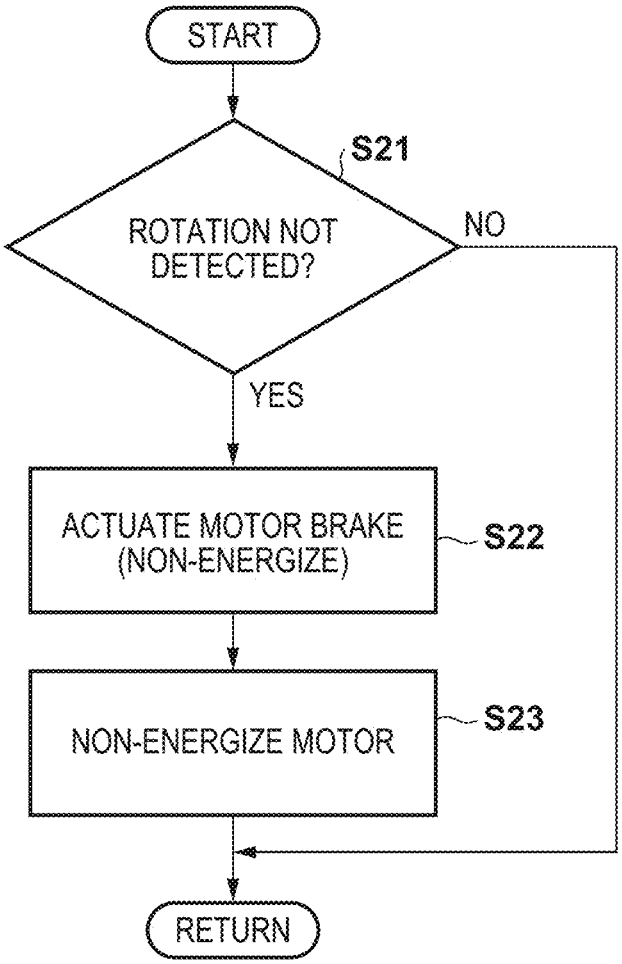
FIG. 6B is a flowchart showing an example of control of the vertical moving apparatus shown in FIG. 1A.

Control executed when the external force F acts on the vertical moving unit 2 to cause an overload state will be described next with reference to FIG. 6B. If an overload state occurs, the movement of the vertical moving unit 2 is stopped, and the detection of the rotation of the motor 41 by the encoder 43 stops. Hence, during raising and lowering of the vertical moving unit 2, the detection result of the encoder 43 is monitored, and it is determined whether the detection of the rotation of the motor 41 by the encoder 43 is being performed (step S21). In this determination, if the detection is being performed, processes of one unit are ended. If the detection is not being performed, the vertical moving unit 2 is considered to have been stopped by the action of the external force F. After that, in step S22, the energization to the electromagnetic brake 42 is cut to set the electromagnetic brake 42 in the braking state. After that, in step S23, the driving of the motor 41 is stopped. If the electromagnetic brake unit 5 is driven, the driving of the electromagnetic brake unit 5 is stopped. By the above-described control, the motor 41 can be stopped more safely at the time of overload stop of the vertical moving unit 2.

The vertical moving apparatus 1 according to this embodiment is adjusted by the above-described load balance and control to such a low thrust that the motor driving is automatically stopped by only light contact of the operator on the vertical moving unit 2 during raising or lowering. For this reason, in the vertical moving apparatus 1 according to this embodiment, facilities of safety measures such as a safety fence and a sensor themselves are unnecessary. It is therefore possible to largely reduce the facility cost in the vertical moving apparatus 1 according to this embodiment and a production line using the vertical moving apparatus 1.

<Vertical Moving System>

Figure 7:
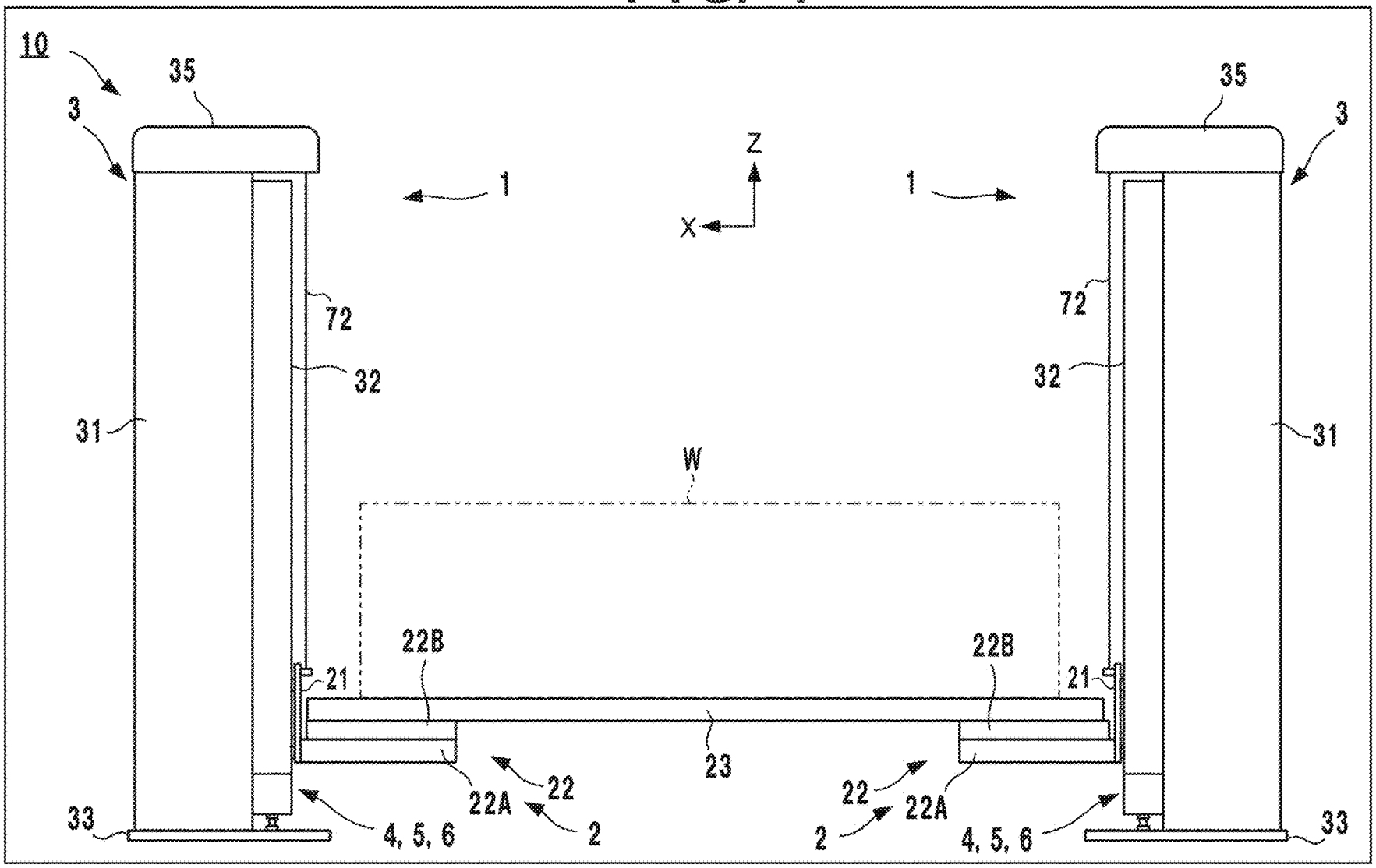
FIG. 7 is an explanatory view of a vertical moving system according to an embodiment of the present invention.

An example of a vertical moving system including a plurality of vertical moving apparatuses 1 will be described. FIG. 7 is an explanatory view (side view) of a vertical moving system 10 according to an embodiment of the present invention.

The vertical moving system 10 includes two vertical moving apparatuses 1 arranged to face each other. A placement member 23 on which a conveyance target object (work W) is placed is laid between the vertical moving units 2 of the two vertical moving apparatuses 1. In this embodiment, the placement member 23 is a long plate member having a rectangular shape on a plan view.

When the two vertical moving apparatuses 1 are driven to vertically move the vertical moving units 2, the placement member 23 is vertically moved, and the work W on the placement member 23 is vertically moved. The two vertical moving apparatuses 1 are independently vertically moved by one control unit 100 without synchronous control. However, the vertical moving apparatuses 1 may be vertically moved while being synchronously controlled by the control unit 100. In the vertical moving system 10 according to this embodiment, the work W that is larger and longer than in the vertical moving apparatus 1 according to the preceding embodiment can be vertically moved.

The placement unit 22 of the vertical moving unit 2 includes a base member 22A and a floating mechanism (slide mechanism) 22B. The base member 22A is a plate-shaped member detachably fixed to the slider 21 in a horizontal orientation. The slide mechanism 22B is placed on the base member 22A and arranged between the base member 22A and the placement member 23.

Figure 8:
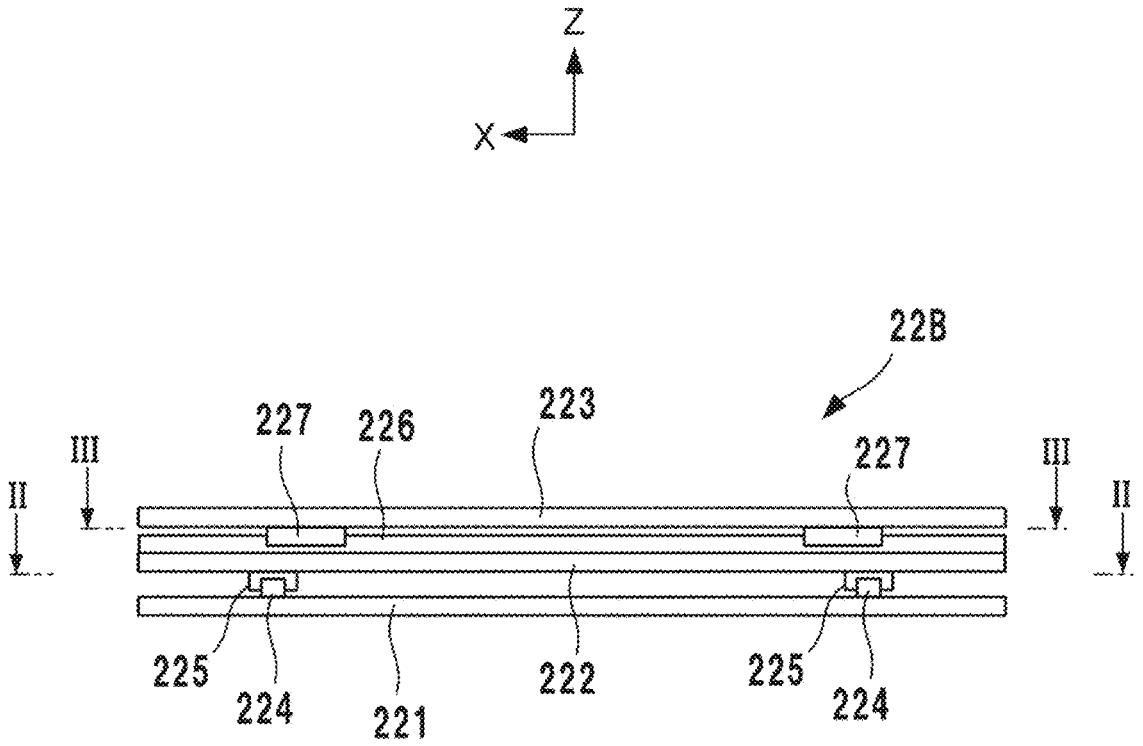
FIG. 8 is an explanatory view of a floating mechanism.
Figure 9:
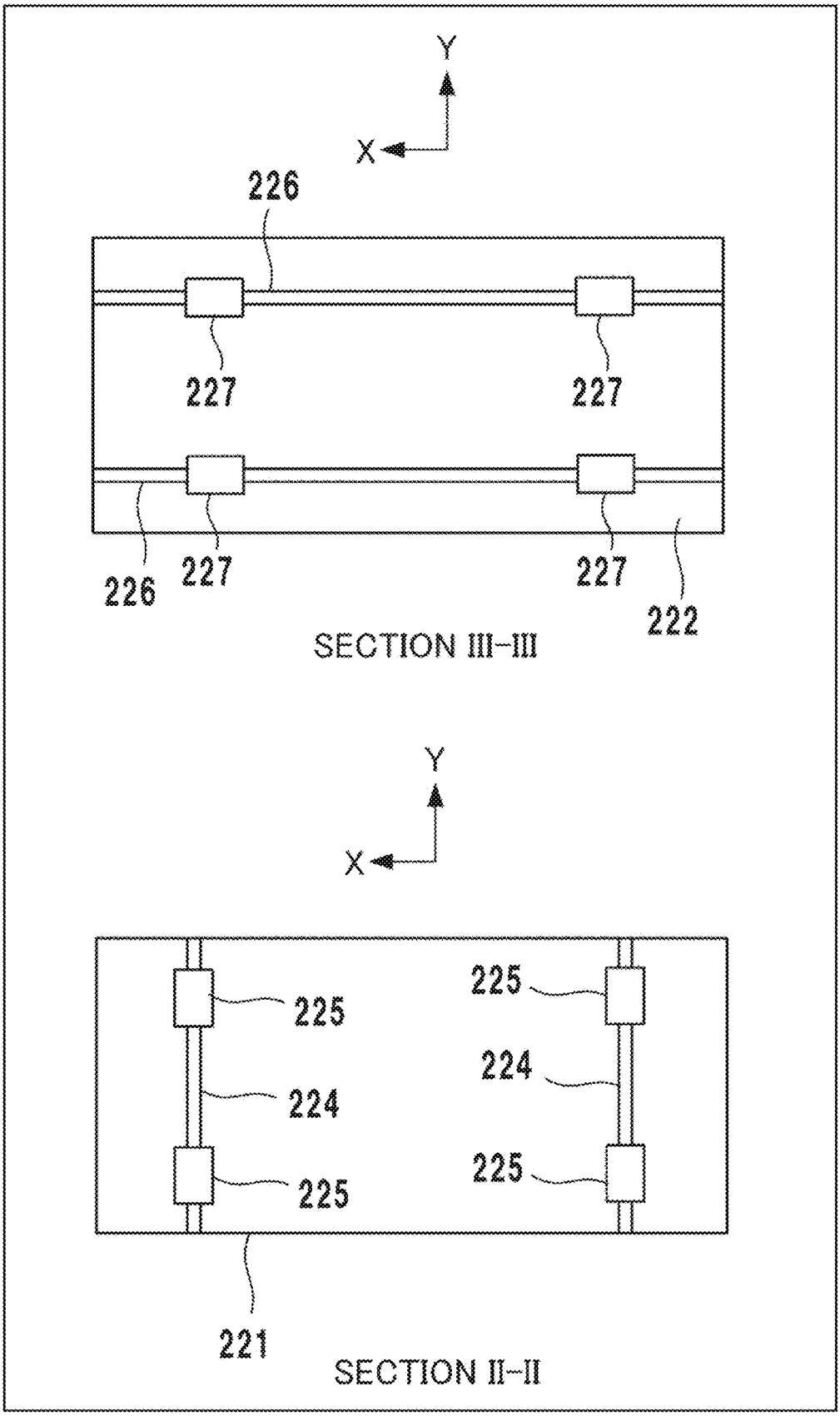
FIG. 9 shows a sectional view taken along a line II-II in FIG. 8 and a sectional view taken along a line III-III in FIG. 8.

FIG. 8 is an explanatory view (side view) of the slide mechanism 22B, and FIG. 9 shows a sectional view (lower side) taken along a line II-II in FIG. 8 and a sectional view (upper side) taken along a line III-III in FIG. 8.

The slide mechanism 22B includes a base table 221 and movable tables 222 and 223. All the base table 221 and the movable tables 222 and 223 are plate-shaped members, and the base table 221, the movable table 222, and the movable table 223 are arranged in a horizontal orientation in this order sequentially from the lower side. The base table 221 is fixed to the base member 22A, and the movable table 223 is fixed to the placement member 23. In this embodiment, a description will be made by exemplifying a case in which the base member 22A and the base table 221 are separate members. However, they may be integrated.

A plurality of rail members 224 and a plurality of sliders 225 are provided between the base table 221 and the movable table 222. The plurality of rail members 224 are fixed on the base table 221 and extended in the Y direction. In this embodiment, two rail members 224 are provided in parallel while being spaced apart in the X direction. The sliders 225 engage with the rail members 224 and are slidable in the Y direction by the guide of the rail members 224. In this embodiment, two sliders 225 are provided on each rail member 224 while being spaced apart in the Y direction. The total of four sliders 225 are fixed to the lower surface of the movable table 222. Hence, the movable table 222 can freely be displaced in the Y direction with respect to the base table 221. The number of rail members 224 and the number of sliders 225 engaging with each rail member 224 are not limited to two, and may be three or more.

A plurality of rail members 226 and a plurality of sliders 227 are provided between the movable table 222 and the movable table 223. The plurality of rail members 226 are fixed on the movable table 222 and extended in the X direction. In this embodiment, two rail members 226 are provided in parallel while being spaced apart in the Y direction. The sliders 227 engage with the rail members 226 and are slidable in the X direction by the guide of the rail members 226. In this embodiment, two sliders 226 are provided on each rail member 226 while being spaced apart in the X direction. The total of four sliders 227 are fixed to the lower surface of the movable table 223. Hence, the movable table 223 can freely be displaced in the X direction with respect to the movable table 222. The number of rail members 226 and the number of sliders 227 engaging with each rail member 226 are not limited to two, and may be three or more.

When the slide mechanism 22B is provided, the placement member 23 is floating-supported such that it can freely be displaced relative to the base member 22A of the vertical moving unit 2 in the horizontal direction. Accordingly, even in a case in which a positional shift occurs between the two vertical moving apparatuses 1, or the component accuracy varies, or in a case in which a height shift occurs because the two vertical moving apparatuses 1 are not synchronously controlled, the positional shift, variation, or height shift can be permitted by the relative displacement between the placement member 23 and the base members 22A. This has an important meaning in low thrust driving characteristic to the vertical moving apparatus 1.

That is, the vertical moving apparatus 1 is adjusted to such a low thrust that the motor driving is automatically stopped by only light contact of the operator. For this reason, if the placement member 23 and the base members 22A are fixed rigidly, "torsion" occurs when the vertical moving apparatuses 1 behave or are driven differently, and the vertical moving apparatuses 1 are automatically stopped. However, since the placement member 23 and the base members 22A are floating-supported, the vertical moving apparatuses 1 can smoothly and simultaneously vertically move without losing the characteristic low thrust driving.

In this embodiment, the slide mechanism 22B is configured to allow the placement member 23 to be freely relatively displaced in both the X direction and the Y direction. However, the placement member 23 may be displaced only in one direction. In addition, the directions of relative displacement need not be the X direction and the Y direction and may be directions shifted from these directions. Furthermore, the system may provide the slide mechanism 22B in only one of the two vertical moving apparatuses 1. However, when the slide mechanisms 22B are provided in both of the two vertical moving apparatuses 1, the placement member 23 can be vertically moved smoothly by a lower thrust.

A free bearing unit may be arranged between the base member 22A and the placement member 23 in addition to the slide mechanism 22B as a floating mechanism. In addition, as another floating mechanism, a gimbal mechanism may be used. In this case, the gimbal mechanism can permit a tilt of the placement member 23 with respect to a horizontal plane. It is also considerable that an elastic member of rubber or the like is used in place of the slide mechanism 22B. However, if the load distribution on the placement member 23 is uneven, the placement member 23 may tilt, and it may be impossible to smoothly vertically move the placement member 23. Since the slide mechanism 22B can be formed by a member with a high rigidity made of a metal material or the like, there is an advantage in suppressing the tilt of the placement member 23.

Other examples of the vertical moving system using the plurality of vertical moving apparatuses 1 will be described next with reference to FIGS. 10 and 11.

Figure 10:
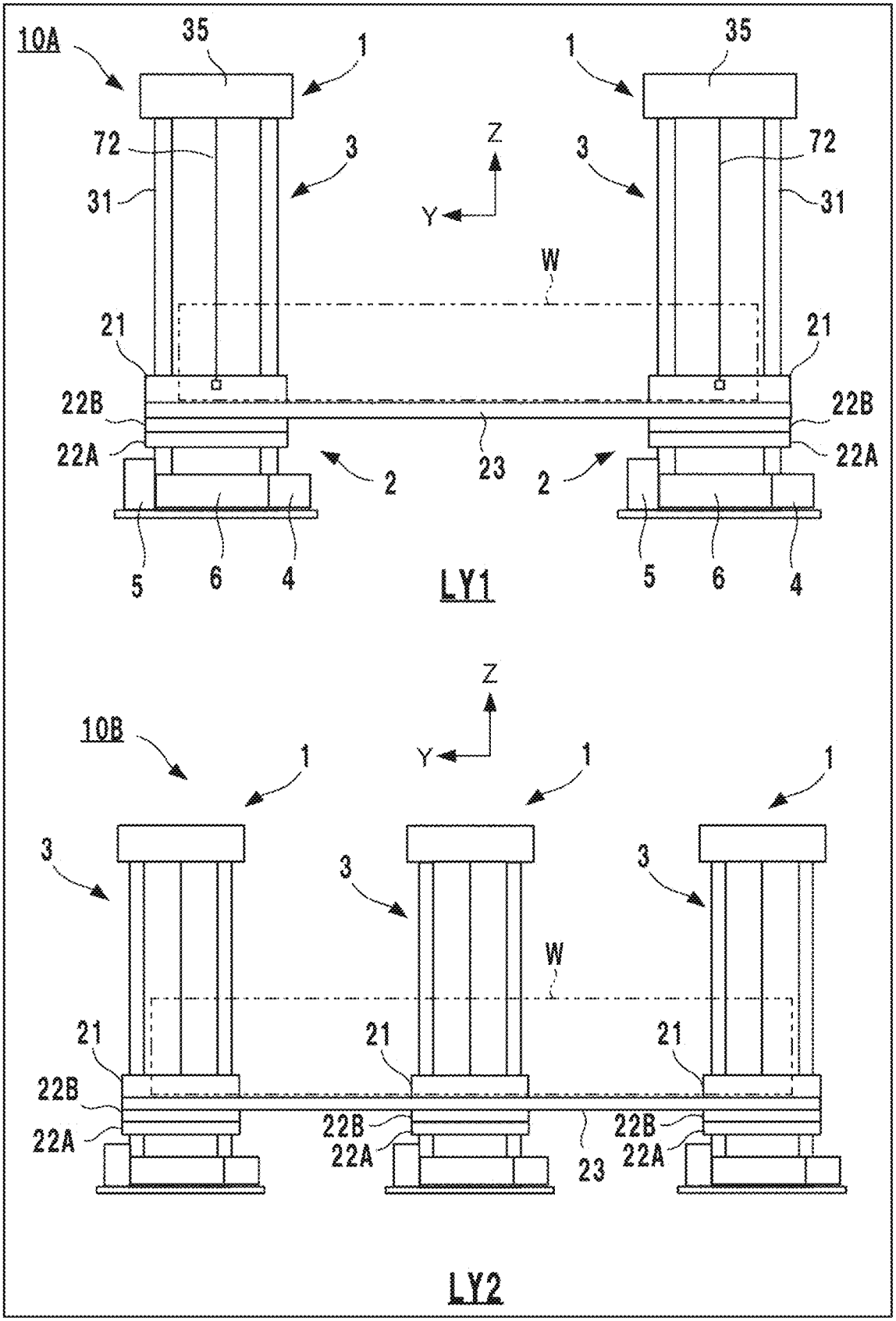
FIG. 10 is a view showing another example of the vertical moving system.

A vertical moving system 10A of an arrangement example LY1 shown in FIG. 10 uses two vertical moving apparatuses 1. However, unlike the example shown in FIG. 7, the vertical moving apparatuses 1 are juxtaposed in one direction (here, the Y direction) in an orientation in which their fronts face the same direction (here, the X direction). The arrangement of each vertical moving apparatus 1 is the same as in the example shown in FIG. 7. The vertical moving unit 2 includes the base member 22A and the slide mechanism 22B, and the placement member 23 is placed on the slide mechanisms 22B. However, the longitudinal direction of the placement member 23 is set to the lateral direction (here, the Y direction) of the vertical moving apparatuses 1. In the vertical moving system 10A according to this modification as well, the same effect as that of the vertical moving system 10 shown in FIG. 7 can be obtained.

A vertical moving system 10B of an arrangement example LY2 shown in FIG. 10 uses three vertical moving apparatuses 1 by adding one vertical moving apparatus 1 to the vertical moving system 10A of the arrangement LY1. The vertical moving apparatuses 1 are juxtaposed in one direction (here, the Y direction) in an orientation in which their front surfaces face the same direction (here, the X direction). Since the placement member 23 is supported by the three vertical moving apparatuses 1, the vertical moving system 10B according to this modification can vertically move the longer and heavier work W.

Figure 11:
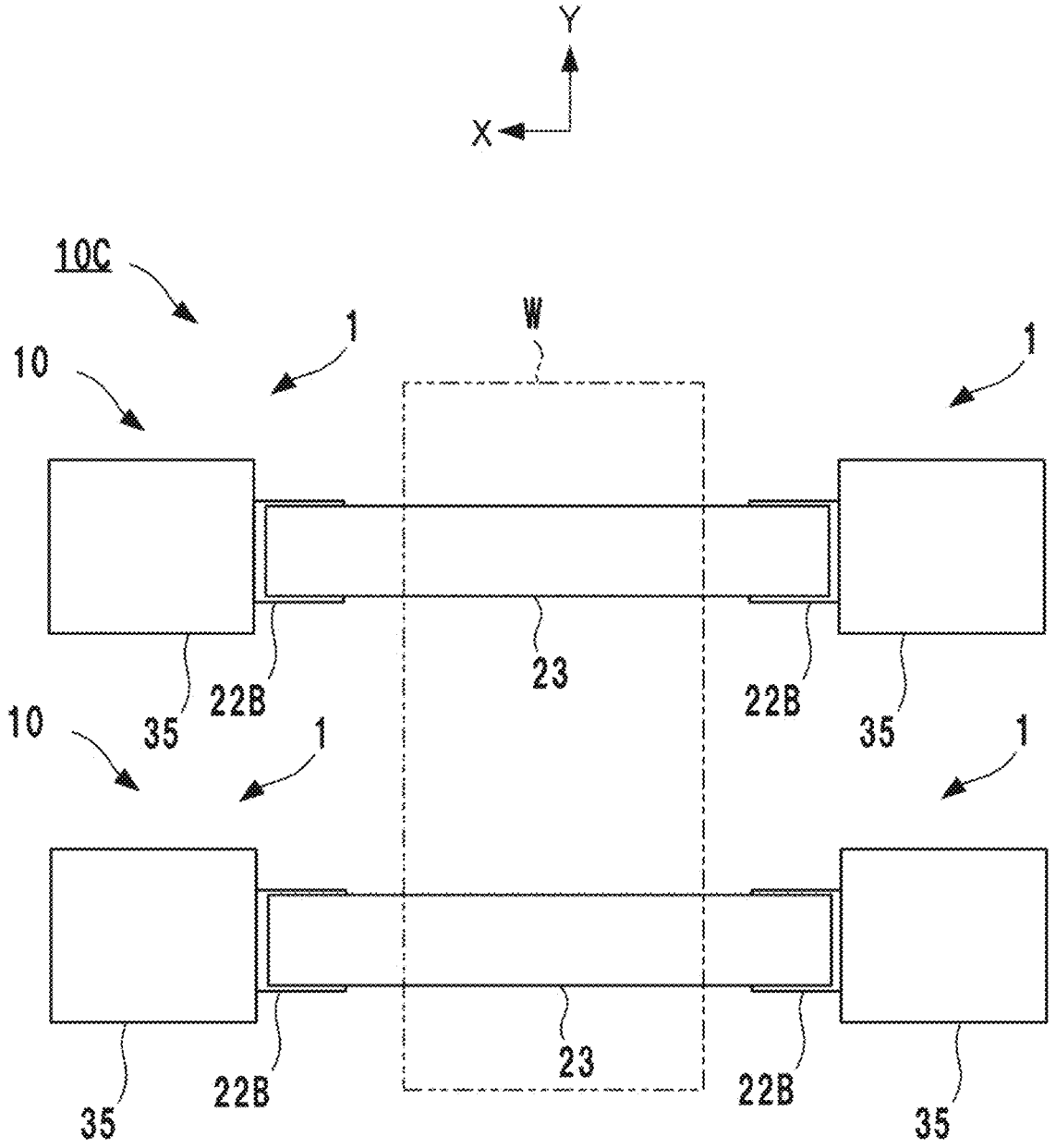
FIG. 11 is a view showing still another example of the vertical moving system.

FIG. 11 is a plan view of a vertical moving system 10C. The vertical moving system 10C includes two sets of the vertical moving systems 10 shown in FIG. 7, and a total of four vertical moving apparatuses 1 are provided. The work W is placed across the placement members 23. The vertical moving system 10C of this example is suitable for a vertical movement of the long and wide work W.

The present invention is not limited to the above embodiments, and various changes and modifications can be made within the spirit and scope of the present invention. Therefore, to apprise the public of the scope of the present invention, the following claims are made.

The invention claimed is:

1. A vertical moving apparatus comprising:

a vertical moving unit on which a conveyance target object is mounted;

a support unit configured to vertically movably support the vertical moving unit;

a non-electric biasing unit configured to generate a biasing force to raise the vertical moving unit;

an electric motor unit configured to generate a thrust for a vertical movement of the support unit;

an electromagnetic brake unit configured to apply a braking force to the vertical movement of the support unit; and a control unit configured to, independently of a weight of the conveyance target object placed on the vertical moving unit, control at least one of the braking force by the electromagnetic brake unit and the thrust by the electric motor unit such that the vertical moving unit stops when an external force of overload more than predetermined value acts on the vertical moving unit during a vertical movement.

2. The vertical moving apparatus according to claim 1, wherein the electric motor unit comprises an electric motor, and a second electromagnetic brake different from the electromagnetic brake unit, and the second electromagnetic brake can brake rotation of an output shaft of the electric motor.

3. The vertical moving apparatus according to claim 1, further comprising a driving mechanism supported by the support unit and configured to transmit a driving force of the electric motor unit to the vertical moving unit, wherein the driving mechanism comprises:

a first rotation body;

a second rotation body; and an endless traveling member wound around the first rotation body and the second rotation body, the vertical moving unit is fixed to the traveling member, and the electric motor unit is connected to the first rotation body or the second rotation body.

4. The vertical moving apparatus according to claim 1, wherein the biasing unit comprises a weight member, and the biasing force is generated using a gravity of the weight member.

5. A vertical moving system comprising:

a first vertical moving apparatus; and a second vertical moving apparatus, wherein each of the first vertical moving apparatus and the second vertical moving apparatus comprises:

a vertical moving unit;

a support unit configured to vertically movably support the vertical moving unit;

a non-electric biasing unit configured to generate a biasing force to raise the vertical moving unit;

an electric motor unit configured to generate a thrust for a vertical movement of the support unit; and an electromagnetic brake unit configured to apply a braking force to the vertical movement of the support unit, the vertical moving system further comprises a placement member laid in a horizontal orientation between the vertical moving unit of the first vertical moving apparatus and the vertical moving unit of the second vertical moving apparatus and configured to place a conveyance target object, and the vertical moving unit of at least one of the first vertical moving apparatus and the vertical moving unit of the second vertical moving apparatus includes a floating mechanism configured to permit relative horizontal movements of the vertical moving unit and the placement member.

6. The vertical moving system according to claim 5, wherein both the vertical moving unit of the first vertical moving apparatus and the vertical moving unit of the second vertical moving apparatus include the floating mechanisms.

7. The vertical moving system according to claim 5, wherein the floating mechanism is a mechanism configured to permit relative movements of the vertical moving unit and the placement member in a first horizontal direction and movements in a second horizontal direction orthogonal to the first horizontal direction.

8. The vertical moving system according to claim 6, wherein the floating mechanism comprises:

a first rail extending in a horizontal direction;

a first slider configured to slide on the first rail;

a movable table supported by the first slider;

a second rail provided on the movable table and extending in the horizontal direction orthogonal of the first rail; and a second slider configured to slide on the second rail.

* * * * *